United States Patent [19]

Tada et al.

[11] Patent Number: 5,028,388

[45] Date of Patent: Jul. 2, 1991

[54] METHOD FOR PRODUCING CHROMIUM CONTAINING MOLTEN IRON WITH LOW SULPHUR CONCENTRATION

[75] Inventors: Chikashi Tada; Keizo Taoka; Sumio Yamada; Hajime Bada, all of Chiba, Japan

[73] Assignee: Kawasaki Steel Corporation, Japan

[21] Appl. No.: 617,424

[22] Filed: Nov. 19, 1990

Related U.S. Application Data

[63] Continuation of Ser. No. 314,709, Feb. 23, 1989, abandoned.

[30] Foreign Application Priority Data

Feb. 24, 1988 [JP] Japan ..... 63-39722

[51] Int. Cl.[5] ..... C22C 37/06

[52] U.S. Cl. ..... 420/71; 420/104; 420/583; 75/623

[58] Field of Search ..... 75/623; 420/71, 104, 420/583

[56] References Cited

U.S. PATENT DOCUMENTS 4,410,360 10/1983 Katayama et al. ..... 75/51.5
4,772,316 9/1988 Radke et al. ..... 75/84

FOREIGN PATENT DOCUMENTS 1433535 3/1969 Fed. Rep. of Germany .
9815 1/1985 Japan ..... 75/84
2085926 5/1982 United Kingdom .

OTHER PUBLICATIONS

Patent Abstracts of Japan, vol. 7, No. 3 (C-143) (1148), Jan. 7th, 1983.
Patent Abstracts of Japan, vol. 11, No. 200 (C-431) (2647), Jun. 27th, 1987.
Patent Abstracts of Japan, vol. 10, No. 373 (C-391) (2430), Dec. 12th, 1986.
Patent Abstracts of Japan, vol. 9, No. 119 (C-282) (1842), May 23rd, 1985.

*Primary Examiner*—Melvyn J. Andrews
*Attorney, Agent, or Firm*—Austin R. Miller

[57] ABSTRACT

Reduction of chromium oxide is performed by utilizing refinement or reduction container having top-blowing capability. Chromium oxide is charged in the molten iron bath in the aforementioned container. Content of slag is adjusted to maintain the following condition:

$CaO/SiO_2$:2.1 to 3.5

$MgO/Al_2O_3$:0.6 to 0.8

17 Claims, 3 Drawing Sheets

METHOD FOR PRODUCING CHROMIUM CONTAINING MOLTEN IRON WITH LOW SULPHUR CONCENTRATION

This application is a continuation of application Ser. No. 314,709, filed Feb. 23, 1989, now abandoned.

BACKGROUND OF THE INVENTION

1. Field of the Invention

The present invention relates generally to a method for producing a chromium containing molten iron. More specifically, the invention relates to reduction of chromium containing molten iron produced from chromium oxide, such as chromium ore, for desulphurization.

2. Description of the Background Art

Japanese Patent First (unexamined) Publication (Tokkai) Showa 60-9815 and Japanese Patent Second (allowed) Publication (Tokko) Showa 62-49346 disclose technologies for melting reduction of chromium oxide, such as chromium ore utilizing a top and bottom-blown converter. In the disclosed technology, chromium oxide and a carbon containing reducing agent which also serves as a heat source, are charged in molten pig iron in a melting bath. Oxygen jet is injected to the molten bath for combustion of carbon to perform reduction of the chromium oxide by the heat generated by combustion of the carbon.

In such melting reduction process, a large amount of carbon containing material, such as coal, is used as heat source and reducing agent. Such carbon containing material generally contains sulphur in a content of 0.5 wt %. Therefore, the concentration of sulphur in the molten iron increases according to the increasing amount of carbon material. The relationship between the amount of carbon material and concentration of sulphur ratio versus overall molten iron amount=% S) is shown in FIG. 6 in the accompanying drawings. Therefore, desulphurization treatment has been required after the reduction process. For example, desulphurization treatment can be performed by flux injection after tapping the molten iron from the converter. This requires an additional process for desulphurization and thus clearly lowers production efficiency.

In order to avoid the need of an additional desulphurization process after tapping, a desulphurization process is generally performed in the converter during the reduction period after decarbonization. However, such process increase the load in the reduction process to create the following problems.

First of all, during the reduction period after the decarbonization process, large amount of ferrosilicon which is known as an inexpensive reduction agent, is used for reduction. Therefore, in order to promote desulphurization, it is required to maintain basicity at a high level. Therefore, the required amount of calcium hydroxide is increased. Secondly, increasing the amount of calcium hydroxide requires the temperature of the melting bath to rise for compensation of heat and for promoting desulphurization. This accelerates damaging of the refractory in the converter wall. Furthermore, in order to maintain the oxygen potential in the melting bath during the desulphurization process, an additional amount of ferrosilicon as a deoxidation agent becomes necessary. In addition, performing desulphurization in the converter necessarily expands the process period in the converter to cause shortening of life of the refractory. Expansion of the process period in the converter also increases the amount of bottom-blown inert gas, such as Ar gas which is expensive.

Therefore, it is desirable to produce a low sulphur concentration molten iron through reduction process.

SUMMARY OF THE INVENTION

Therefore, it is an object of the present invention to provide a novel reduction process for producing chromium containing molten iron which has a low sulphur concentration so as not to require an additional desulphurization process It has been discovered that effective melting reduction of chromium ore and semi-reduced pellet can be performed in a melting reduction furnace. Effective reduction which can be performed in the melting reduction furnace results in low oxygen potential in the slag and molten iron to effectively promote the desulphurizing reaction.

As is well known, in order to promote the desulphurizing reaction, it is required to increase the basicity level, to increase the temperature of the molten iron and to lower the oxygen concentration in the molten iron. In case of reduction of chromium oxide, improvement of yield and minimizing of damage to be caused to the retractory has to be achieved. After various experiments, the inventors have found that effective reduction of chromium oxide with satisfactorily high yield and with minimizing melting of the retractory can be obtained under the following condition.

According to the present invention, reduction of chromium oxide is performed by utilizing a refinement or reduction container having top-blowing capability. Chromium oxide is charged in the molten iron bath in the aforementioned container. The content of the slag is adjusted to maintain the following condition:

$CaO/SiO_2$:2.1 to 3.5

$MgO/Al_2O_3$:0.6 to 0.8

In order to implement the reduction process according to the present invention, it is required to provide strong stirring ability for promoting the reaction between the charge and the molten iron bath. Therefore, the container to be used for the process according to the invention should have capability of top-blowing. Furthermore, the container should associate with a facility which can provide an intermittent or continuous charge of chromium containing oxide, such as chromium ore, semi-reduced chromium pellet, carbon containing material, dolomite, calcium hydroxide and other charges.

According to one aspect of the invention, a process for producing chromium containing molten iron with low sulphur content, comprises the steps of:

providing a container which has a top-blowing injection capability;

forming a molten iron bath in the container with molten pig iron;

preparing slag to provide $CaO/SiO_2$ in a range of 2.1 to 3.5 and $MgO/Al_2O_3$ in a range of 0.6 to 0.8; and charging chromium containing material and reducing agent containing material to the molten iron bath in the container.

The process according to the invention, controls the content of sulphur in the final product of molten iron top a value smaller than or equal to 0.015 wt %. Also, the process according to the present invention is designed for producing molten iron containing chromium in a range of about 5 wt % to 35 wt %.

Further preferably, the process comprises a step of continuously charging flux an a controlled amount so as to maintain the ratio $CaO/SiO_2$ in the range of 2.3 to 3.5 in order to control the content of sulphur in the final product of molten iron to a value smaller than or equal to 0.008%.

In the preferred process, the container comprises a top and bottom-blown converter. The chromium containing material and the reducing agent containing material are agitated from the top of the converter. The process may further comprises the step of continuously charging melting promotion additive in a controlled amount so as to maintain the ratio $CaO/SiO_2$ in the range of 2.1 to 3.5 and $MgO/Al_2O_3$ in the range of 0.6 to 0.8. The melting promoting agent is lime, or dolomite. The amount of the melting promoting agent may be determined according to the amount of charge of the chromium containing material and the reducing agent containing material.

According to another aspect of the invention, the process for producing chromium containing molten iron with low sulphur content comprises the steps of:

forming a molten iron bath in a top and bottom-blown converter with molten pig iron;

adjusting the ratio $CaO/SiO_2$ in the slag in the molten iron bath in a range of 2.1 to 3.5; and charging chromium containing material and carbon containing material to the molten iron bath in the container.

In the practical implementation of the chromium reducing process, according to the present invention, set forth above, the process comprises the steps of:

charging chromium containing scrap and molten pig iron to a top and bottom-blown converter for forming a molten iron bath;

performing a scrap melting and heating stage operation with top blowing of oxygen while charging carbon containing material and slag forming agent through the top of the converter for melting the chromium containing scrap and heating the molten iron bath to a predetermined temperature; and performing a reduction stage operation subsequent to the scrap melting and heating stage operation, in which top blowing of oxygen while charging carbon containing material and chromium oxide through the top of the converter for reducing chromium and thus forming the chromium containing molten iron.

Further practically, the scrap melting and heating stage operation is performed for heating the molten iron bath at a temperature higher than or equal to 1500° C. In addition, it is preferable that the scrap melting and heating stage operation is performed to establish a relationship between carbon concentration [C] and chromium concentration [Cr] satisfying the following formula:

$$[C] \geqq 4.03 + 0.84 \times [Cr]$$

In addition, the scrap melting and heating stage may be separated into two series steps, in which a first scrap melting step is performed in advance of a second heating step, for melting the scrap and the second heating step is performed subsequent to the first scrap melting step for increasing the temperature of the molten iron bath to a temperature higher than or equal to 1500° C. and adjusting, carbon concentration [C] versus chromium concentration [Cr] to satisfy the following formula:

$$[C] \geqq 4.03 + 0.84 \times [Cr]$$

The process may further comprise the step of monitoring the condition of the molten iron bath and detecting a timing for transition between the first scrap melting step and the heating step on the basis of the monitored condition.

BRIEF DESCRIPTION OF THE DRAWINGS

The present invention will be understood more fully from the detailed description given herebelow and from the accompanying drawings which illustrate results of experiments, which, however, should not be taken to limit the invention but are for explanation and understanding only.

In the drawings.

DETAILED DESCRIPTION OF THE INVENTION

As set forth above, according to the present invention, reduction of chromium oxide is performed by utilizing a refinement or reduction container having top-blowing capability. Chromium oxide is charged in the molten iron bath in the aforementioned container. Content of slag is adjusted to maintain the following condition:

$$CaO/SiO_2: 2.1 \text{ to } 3.5$$

$$MgO/Al_2O_3: 0.6 \text{ to } 0.8$$

In order to implement the reduction process according to the present invention, it is required to provide strong stirring ability for promoting reaction between the charge and molten iron bath. Therefore, the container to be used for the process according to the invention should have capability of top-blowing. Furthermore, the container should associate with a facility which can introduce an intermittent or continuous charge of chromium containing oxide, such as chromium ore, semi-reduced chromium pellet, carbon containing material, dolomite, lime and other charges.

Figure 1:
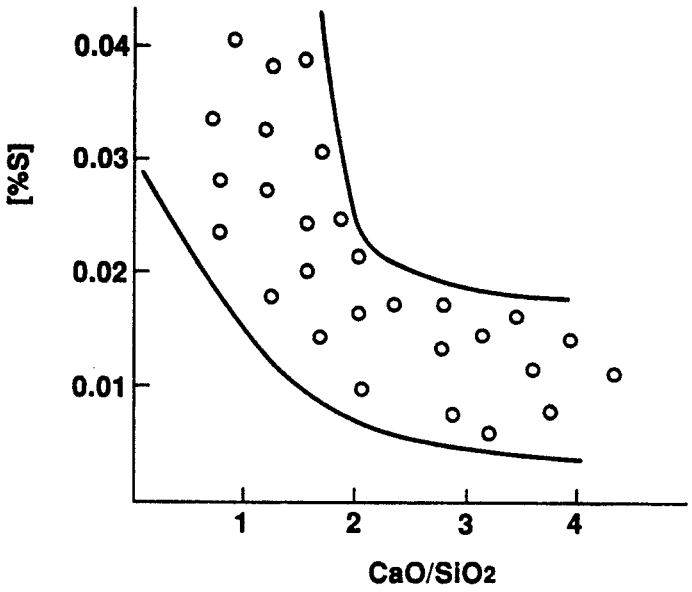
FIG. 1 is a graph showing relationship between $CaO/SiO_2$ in slag and sulphur concentration (% S) in molten iron.

In order to implement that process according to the present invention, molten pig iron (85 tons) was filled in a top and bottom blown converter. The molten pig iron contained more than or equal to 3.5 wt % of C for forming a molten metal bath. The temperature of the molten pig iron was in a range of 1500° C. to 1600° C. Semi-reduced Cr pellets (250 Kg/t to 400 Kg/t) and coke 200 Kg/t to 300 Kg/t were charged. Melting reduction was performed for obtaining molten iron containing 10 wt % to 20 wt % of Cr. During the process the relationship between $CaO/SiO_2$ and sulphur content in the molten iron was checked. The result is shown in FIG. 1. As will be seen from FIG. 1, increasing the ratio $CaO/SiO_2$, increases desulphurizing efficiency. When the ratio $CaO/SiO_2$ is smaller than 2.1, the sulphur content in the molten iron fluctuates at a significant level and one cannot stably obtain low sulphur concentration in the molten iron.

Figure 2:
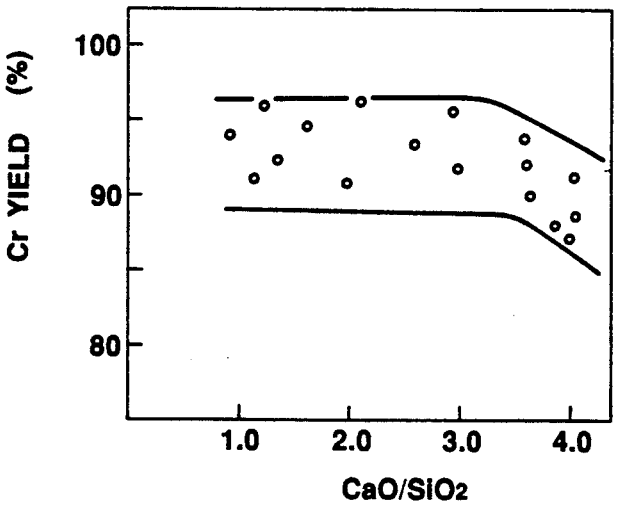
FIG. 2 is graph showing relationship between $CaO/SiO_2$ and chromium reduction yield.

In the same condition, the relationship between $CaO/SiO_2$ and Cr reduction yield was checked. The result is shown in FIG. 2. The Cr reduction yield was obtained from the following equation:

$$\text{Yield} = \{(\text{Output Cr (kg)})/(\text{Input Cr (kg)})\} \times 100\ (\%)$$

As will be clear from FIG. 2, the yield was lowered with increase of the ratio $CaO/SiO_2$. Lowering of yield is considered to be caused by increasing slag volume, by splashing of the molten iron, by granulating loss and by slow-down of solidification of the slag, to cause lowering of reduction speed of Cr oxide. As seen from FIG. 2, the yield drops substantially when $CaO/SiO_2$ becomes greater than 3.5. Therefore, the preferred range of $CaO/SiO_2$ is in a range of 2.1 to 3.5.

When reduction of Cr oxide is performed by adjusting the ratio $CaO/Sio_2$ in the slag in the range set forth above, sulphur concentration in the molten iron bath still fluctuated in a range of 0.005 wt % to 0.020 wt %. In order to more stably and more effectively perform desulphurization, various attempts were performed. After various experiments, the inventors have found that the ratio $MgO/Al_2O_3$ was an effective parameter for stably obtaining chromium containing molten iron with low sulphur content.

As is well known, MgO and $Al_2O_3$ are contained in Cr ore. Accordingly, when the amount of Cr ore to charge in the molten iron bath is increased, concentrations of MgO and $Al_2O_3$ are naturally increased. This increases the total amount of Cr (T.Cr) contained in the slag to lower Cr reduction yield. In the preferred process, since the ratio $CaO/SiO_2$ is adjusted in the range of 2.1 to 3.5 in the slag, CaO is effective to dilute MgO and $Al_2O_3$.

Figure 3:
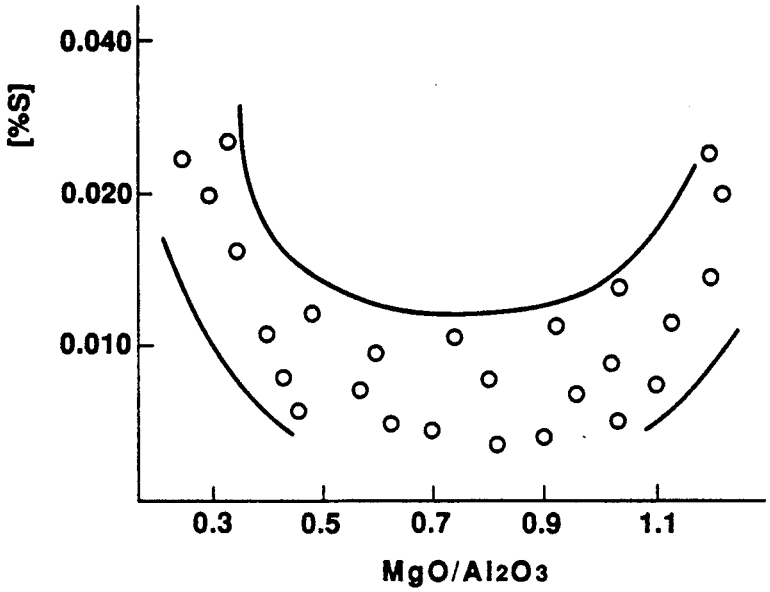
FIG. 3 is a graph showing relationship between $MgO/Al_2O_3$ in slag and sulphur concentration (% S) in molten iron.
Figure 4:
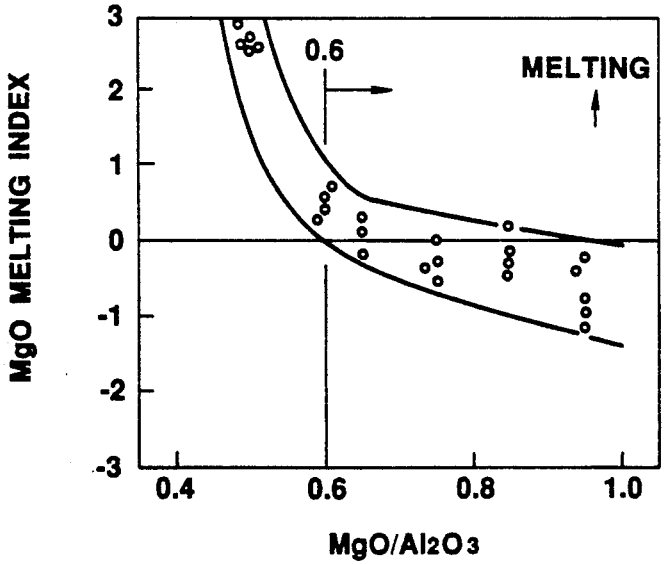
FIG. 4 is a graph showing relationship between $MgO/Al_2O_3$ in slag and melting index of MgO.

While maintaining the ratio $CaO/SiO_2$ in the range of 2.1 to the relationship involving $MgO/Al_2O_3$ was checked and result is shown in FIG. 3. As seen from FIG. 3, by adjusting the ratio $MgO/Al_2O_3$ in a range of 0.5 to 1.0, Cr containing molten iron with low sulphur content smaller than or equal to 0.015 wt % can be stably produced. On the other hand, when adjusting $MgO/Al_2O_3$ in the range of 0.5 to 1.0, charge to cause substantial melting of refractory can be created. FIG. 4 shows the relationship between the MgO melting amount as represented by the MgO melting index and the ratio $MgO/Al_2O_3$. The MgO melting index is derived by calculating the slag amount on the basis of $Al_2O_3$ concentration and performing a balance calculation. The melting index in positive value (+) represents that MgO in the refractory is melting out and in negative value (−) represents that MgO is adhering on the refractory. As seen from FIG. 4, in order to maintain the MgO melting index smaller than or equal to 0.5, the ratio $MgO/Al_2O_3$ is to be adjusted to a value greater than or equal to 0.60.

Figure 5:
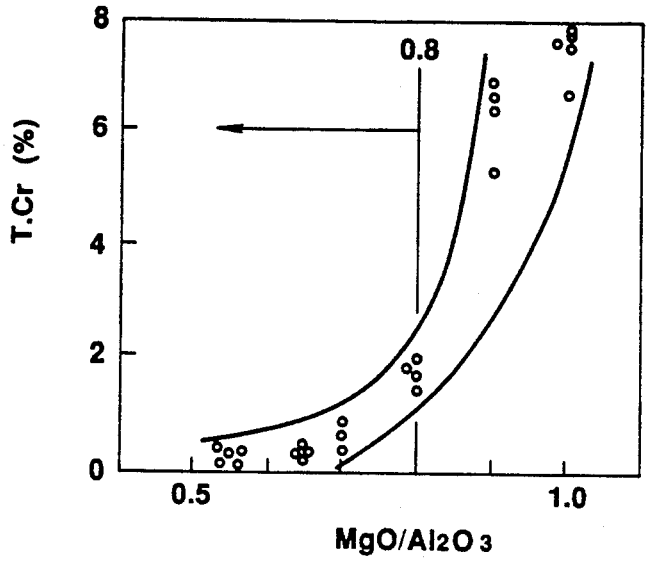
FIG. 5 is a graph showing relationship between $MgO/Al_2O_3$ and T.Cr amount.
Figure 6:
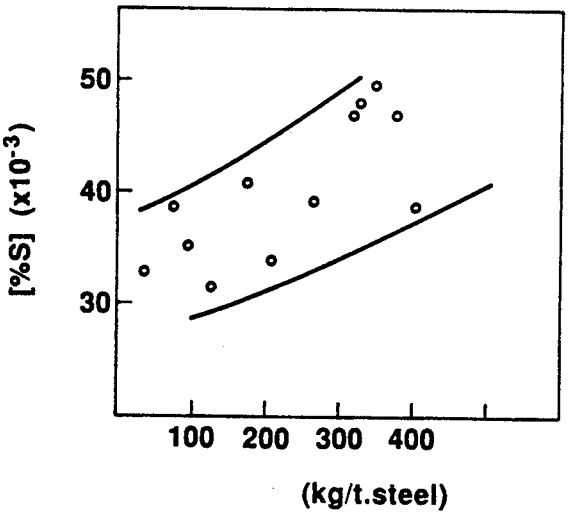
FIG. 6 is a graph showing relationship between carbon material amount and sulphur concentration (% S) in molten iron bath.

FIG. 5 shows relationship between T.Cr amount (wt %) and $MgO/Al_2O_3$ As seen from FIG. 5, $MgO/Al_2O_3$ is required to be smaller than or equal to 0.8 for improving Cr reduction yield. If $MgO/Al_2O_3$ is greater than 0.8, the reduction speed is lowered to cause lowering of the Cr reduction yield.

$MgO/Al_2O_3$ can be adjusted by adjusting the amount of charge of dolomite and $Al_2O_3$ depending upon the $MgO/Al_2O_3$ amount contained in Cr ore.

In view of the various factors set out above, the preferred range of $MgO/Al_2O_3$ is 0.6 to 0.8. By setting $MgO/Al_2O_3$ in the range set forth above and setting $CaO/SiO_2$ in the range of 2.1 to 3.5, a Cr containing molten iron having a satisfactorily low sulphur concentration, i.e. lower than or equal to 0.015 wt %, can be stably produced without causing substantial damage of the refractory.

EXAMPLE 1

Utilizing a top and bottom-blown converter having a capacity of 85 tons, reduction process according to the present invention was performed to produce 14% chromium containing molten iron. Molten pig iron filled in the converter had the content as set out in the following table I.

TABLE I

| C | Si | Mn | P | (wt %) S |
|---|---|---|---|---|
| 4.15 | Tr | 0.07 | 0.011 | 0.032 |

Temperature of the molten iron was 1190° C. The molten iron was filled in an the converter in amount of 63.8 tons. Coke and semi-reduced Cr pellets were continuously charged. Semi reduced Cr pellet had content as shown in table II.

TABLE II

| T.Cr | T.Fe | $SiO_2$ | $Al_2O_3$ | CaO | MgO | P | (wt %) S |
|---|---|---|---|---|---|---|---|
| 32.18 | 22.23 | 4.72 | 17.28 | 0.45 | 9.10 | 0.024 | 0.128 |

Amounts of lime and dolomite dolomite were adjusted according to the charge amount of coke and semi-reduced Cr pellet so that composition of slag could be adjusted to be suitable for implementing the preferred reduction process according to the present invention. In the shown implement, the ratio $CaO/SiO_2$ was set at 2.5 and the ratio $MgO/Al_2O_3$ was set at 0.65. Amounts of lime, coke, semi-reduced Cr pellet and top-blown oxygen were as shown in the following table III.

TABLE III

| Cr Pellet | Coke | Lime | Dolomide | $O_2$ |
|---|---|---|---|---|
| 36.09 t | 33.24 t | 6.55 t | 2.61 t | 23346 $Nm^3$ |

Composition of molten iron after the preferred reduction process according to the invention is shown in the following table IV and composition of slag is shown in the following table V. The results shown in the tables IV and V were obtained after reduction process for a period of 87.6 minutes, the amount of tapped molten iron was 75.1 tons and the Cr reduction ratio was 91.82%.

TABLE IV

| Tapping Temp. | C | Si | Mn | P | S | Cr | (wt %) Cr Yield |
|---|---|---|---|---|---|---|---|
| 1556° C. | 6.02 | Tr | 0.21 | 0.29 | 0.003 | 14.20 | 91.82 |

TABLE V

| T.Fe | T.C | $SiO_2$ | MnO | $P_2O_5$ | S | (wt %) $Al_2O_3$ |
|---|---|---|---|---|---|---|
| 0.7 | 0.23 | 14.5 | 0.1 | 0.01 | 0.50 | 25.97 |

| CaO | MgO | T.Cr | $CaO/SiO_2$ | $MgO/Al_2O_3$ |
|---|---|---|---|---|
| 35.0 | 16.65 | 0.6 | 2.41 | 0.64 |

As will be appreciated from the tables IV and V, by adjusting $CaO/SiO_2$ and $MgO/Al_2O_3$ in the ranges set forth above, chromium-containing molten iron with satisfactorily low sulphur content can be effectively produced without causing damage on the refractory.

EXAMPLE 2

Utilizing a top and bottom-blown converter having a capacity of 85 tons, reduction process according to the present invention was performed to produce 14% chromium containing molten iron. Molten pig iron filled in the converter had the content as set out in the following table VI.

TABLE VI

| C | Si | Mn | P | (wt %) S |
|---|---|---|---|---|
| 4.07 | 0.02 | 0.04 | 0.014 | 0.051 |

Temperature of the molten iron was 1235° C. The molten iron was filled in the converter in an amount of 65.3 tons. Coke and semi-reduced Cr pellets were continuously charged. Semi-reduced Cr pellets had contents as shown in the foregoing table II.

Amounts of lime and dolomite were adjusted according to the charged amount of coke and semi-reduced Cr pellets so that composition of slag could be adjusted to be suitable for implementing the preferred reduction process according to the present invention. In the shown implement, the ratio $CaO/SiO_2$ was set at 2.5 and the ratio $MgO/Al_2O_3$ was set at 0.65. Amounts of lime, coke, semi-reduced Cr pellet and top-blown oxygen were as shown in the following table VII.

TABLE VII

| Cr Pellet | Coke | Lime | Dolomide | $O_2$ |
|---|---|---|---|---|
| 37.38 t | 29.74 t | 5.28 t | 3.65 t | 21351 $Nm^3$ |

Composition of molten iron after the preferred reduction process according to the invention is shown in the following table VIII and composition of slag is shown in the following table IX. The results shown in the tables VIII and IX were obtained after reduction process for a period of 75.5 minutes, amount of tapped molten iron was 72.4 tons and Cr reduction ratio was 91.14%. In this experiment, MgO melting index was −0.36.

TABLE VIII

| Tapping Temp. | C | Si | Mn | P | S | Cr | (wt %) Cr Yield |
|---|---|---|---|---|---|---|---|
| 1562° C. | 6.02 | 0.01 | 0.16 | 0.29 | 0.012 | 13.91 | 91.14 |

TABLE IX

| T.Fe | T.C | $SiO_2$ | MnO | $P_2O_5$ | S | (wt %) $Al_2O_3$ |
|---|---|---|---|---|---|---|
| 0.5 | 0.04 | 13.7 | 0.1 | 0.01 | 0.531 | 28.64 |

| CaO | MgO | T.Cr | $CaO/SiO_2$ | $MgO/Al_2O_3$ |
|---|---|---|---|---|
| 29.2 | 19.96 | 0.5 | 2.13 | 0.696 |

EXAMPLE 3

Utilizing a top and bottom blown converter having capacity of 85 tons, a reduction process according to the present invention was performed to produce 14% chromium containing molten iron. Molten pig iron filled in the converter had the content as set out in the following table X.

TABLE X

| C | Si | Mn | P | (wt %) S |
|---|---|---|---|---|
| 4.09 | 0.02 | 0.05 | 0.016 | 0.049 |

Temperature of the molten iron was 1230° C. The molten iron was filled in the converter in an amount of 71.1 tons. Coke and semi-reduced Cr pellets were continuously charged. Semi-reduced Cr pellets had a content as shown in foregoing table II.

Amounts of lime and dolomite were adjusted according to the charged amount of coke and semi-reduced Cr pellets so that the composition of slag could be adjusted to be suitable for implementing the preferred reduction process according to the present invention. In the shown experiment, the ratio $CaO/SiO_2$ was set at 3.2 and the ratio $MgO/Al_2O_3$ was set at 0.75. Amounts of lime, coke, semi reduced Cr pellet and top-blown oxygen were as shown in the following table XI.

TABLE XI

| Cr Pellet | Coke | Lime | Dolomide | $O_2$ |
|---|---|---|---|---|
| 38.90 t | 34.17 t | 5.87 t | 4.88 t | 24078 $Nm^3$ |

Composition of molten iron after the preferred reduction process according to the invention is shown in the following table XII and composition of slag is shown in the following table XIII. The results shown in the tables XII and XIII were obtained after reduction process for a period of 82.5 minutes, amount of tapped molten iron was 85.5 tons and Cr reduction ratio was 96.2%. In this experiment, MgO melting index was −0.17.

TABLE XII

| Tapping Temp. | C | Si | Mn | P | S | Cr | (wt %) Cr Yield |
|---|---|---|---|---|---|---|---|
| 1574° C. | 6.20 | 0.03 | 0.17 | 0.30 | 0.001 | 15.14 | 96.2 |

TABLE XIII

| T.Fe | T.C | $SiO_2$ | MnO | $P_2O_5$ | S | (wt %) $Al_2O_3$ |
|---|---|---|---|---|---|---|

TABLE XIII-continued

| | | | | | | |
|---|---|---|---|---|---|---|
| 0.6 | 1.69 | 12.2 | 0.1 | 0.01 | 0.606 | 25.44 |
| CaO | MgO | T.Cr | $CaO/SiO_2$ | | $MgO/Al_2O_3$ | |
| 39.0 | 19.29 | 0.6 | 3.20 | | 0.76 | |

EXAMPLE 4

Utilizing a top and bottom blown converter having capacity of 85 tons, reduction process according to the present invention was performed to produce 14% chromium containing molten iron. Molten pig iron filled in the converter had the content as set out in the following table XIV.

TABLE XIV

| | | | | (wt %) |
|---|---|---|---|---|
| C | Si | Mn | P | S |
| 4.15 | 0.01 | 0.05 | 0.009 | 0.034 |

Temperature of the molten iron was 1190° C. The amount of the molten iron was filled in the converter in amount of 60.8 tons. Coke and semi-reduced Cr pellets were continuously charged. Semi reduced Cr pellet had content as shown in foregoing table II.

Amounts of lime and dolomite were adjusted according to the charged amount of coke and semi-reduced Cr pellets so that composition of slag could be adjusted to be suitable for implementing the preferred reduction process according to the present invention. In the shown experiment, the ratio $CaO/SiO_2$ was set at 2.5 and $MgO/Al_2O_3$ was set at 0.7. Amounts of lime, coke, semi-reduced Cr pellet and top-blown oxygen were as shown in the following table XV.

TABLE XV

| Cr Pellet | Coke | Lime | Dolomide | $O_2$ |
|---|---|---|---|---|
| 38.07 t | 29.88 t | 5.82 t | 3.74 t | 21778 $Nm^3$ |

Composition of molten iron after the preferred reduction process according to the invention is shown in the following table XVI and composition of slag is shown in the following table XVII. The results shown in the tables XVI and XVII were obtained after reduction process for a period of 79.3 minutes, amount of tapped molten iron was 79.0 tons and Cr reduction ratio was 92.73%. In this experiment, MgO melting index was −0.15.

TABLE XVI

| | | | | | | | (wt %) |
|---|---|---|---|---|---|---|---|
| Tapping Temp. | C | Si | Mn | P | S | Cr | Cr Yield |
| 1556° C. | 6.03 | 0.01 | 0.15 | 0.30 | 0.003 | 14.81 | 95.50 |

TABLE XVII

| | | | | | | (wt %) |
|---|---|---|---|---|---|---|
| T.Fe | T.C | $SiO_2$ | MnO | $P_2O_5$ | S | $Al_2O_3$ |
| 0.5 | 0.18 | 13.4 | 0.1 | 0.01 | 0.583 | 28.45 |
| CaO | MgO | T.Cr | $CaO/SiO_2$ | | $MgO/Al_2O_3$ | |
| 32.40 | 20.75 | 0.6 | 2.42 | | 0.73 | |

EXAMPLE 5

In order to practically implement the chromium reducing process according to the present invention, another experiment was carried out through the following process which comprises the steps of:

charging chromium containing scrap and molten pig iron to a top and bottom-blown converter for forming a molten iron bath;

performing a scrap melting and heating stage operation in which top blowing of oxygen while charging carbon containing material and slag forming agent through the top of said converter for melting said chromium containing scrap and heating said molten iron bath to a predetermined temperature; and performing a reduction stage operation subsequent to said scrap melting and heating stage operation, with top blowing of oxygen while charging carbon containing material and chromium oxide through the top of said converter for reducing chromium and thus forming chromium containing molten iron.

Further practically, the scrap melting and heating stage operation is performed for heating said molten iron bath at a temperature higher than or equal to 1500° C. In addition, it is preferable that the scrap melting and heating stage operation is performed to establish a relationship between carbon concentration [C] and chromium concentration [Cr] satisfying the following formula:

$$[C] \geqq 4.03 + 0.84 \times [Cr]$$

In the experiment, in charging the converter, stainless steel scrap in an amount of 22.9 tons was charged by means of a scrap chute. After charging the stainless steel scrap, dephosphorized molten pig iron in an amount of 41.3 tons was charged. Immediately after charging the molten pig iron, the converter was set at the vertical position and blowing was performed. Composition of the stainless steel scrap and amount of scrap are shown in the following table XVIII.

TABLE XVIII

| | C | Si | P | S | Cr | Ni | Weight (ton) | Total Weight (ton) |
|---|---|---|---|---|---|---|---|---|
| SUS304 Heavy Scrap | 0.07 | 0.45 | 0.040 | 0.010 | 18.15 | 8.50 | 6.4 | 22.9 |
| SUS304 Light Scrap | 0.07 | 0.45 | 0.040 | 0.010 | 18.15 | 8.50 | 16.5 | |

On the other hand, the composition of dephosphorized molten pig iron is shown in the following table XIX.

TABLE XIX

| Temp. °C. | C | Si | Mn | P | S | Cr | Ni |
|---|---|---|---|---|---|---|---|
| 1170 | 4.41 | tr | 0.03 | 0.010 | 0.024 | — | — |

After blowing oxygen in an amount of 5500 $Nm^3$, a sub lance was inserted into the molten iron bath for measuring the temperature thereof. The temperature was 1525° C. In the scrap melting process and before measuring the temperature of the molten iron bath, 280 kg of lime was charged for compensating basicity for Si contained in the scrap. At the blowing of oxygen in amount of 5500 $Nm^3$, the temperature increase coefficient k can be obtained from the following condition:

| | |
|---|---|
| molten pig iron temperature: | 1170 °C. |
| measured molten iron temperature: | 1525 °C. |

-continued

| | |
|---|---|
| amount of molten pig iron: | 41.3 tons |
| amount of scrap: | 22.9 tons |

$$k=\{(1525-1170)/5500\}\times(41.3+22.9)=4.14$$

The molten iron temperature was again measured after blowing oxygen in amount of 6200 $Nm^3$. The measured molten iron temperature was 1565° C. From this, the temperature increase coefficient k is derived from:

$$k=\{(1565-1525)/(6200-5500)\}\times(41.4+22.9)=3.67$$

Judgement could be made that the scrap was melted at this time.

In the shown experiment, a target temperature for performing the Cr reducing process was set at 1575° C. Therefore, in the heating step, a temperature increase of 10° was required. For increasing the molten iron temperature by 5° C., the required oxygen amount to blow can be derived from:

$$\{(1575-1565)/3.67\}\times(41.3+22.9)=175\ Nm^3O_2$$

Therefore, after blowing 180 $Nm^3$ of oxygen in the heating step, the process moves to the second Cr reduction step.

Through the scrap melting step and the heating step, the carbon containing material, i.e. coke was charged in a ratio of 1.8 kg/$Nm^3O_2$. The process time from the beginning of the process to the beginning of the Cr reduction process was 28.6 min.

Here, regarding the % Cr of scrap and the charged weight of scrap, the % Cr in the molten iron bath can be derived by:

$$\{(6.4+16.5)\times0.1815/(22.9+41.4)\}\times100=6.47\%$$

From this, it is appreciated that the % C has to be greater than or equal to 4.57. After blowing 6200 $Nm^3$ of oxygen, the % C derived from the analysis of measured data by means of the sub lance was 4.60 which satisfies the formula of:

$$[\%\ C]\geqq4.03+0.084\times[\%Cr]$$

In the reduction process, in order to maintain the molten iron bath temperature constant and in order to maintain heat balance, semi-reduced Cr pellet of 2.4 kg/$Nm^3$ $O_2$ and carbon containing material of 1.3 kg $Nm^3$ $O_2$ were charged. The composition of the semi-reduced Cr pellet is shown in the following table XX.

TABLE XX

| T.Cr | SolCr | T.Fe | SolFe | Reduction Ratio | (wt %) $SiO_2$ |
|---|---|---|---|---|---|
| 32.18 | 19.68 | 22.23 | 20.06 | 69.89 | 4.72 |
| $Al_2O_3$ | CaO | MgO | P | S | |

TABLE XX-continued

| | | | | |
|---|---|---|---|---|
| 17.28 | 0.45 | 10.29 | 0.024 | 0.128 |

After completing charging of semi-reduced Cr pellets set forth above and after blowing oxygen in an amount of 18000 $Nm^3$, the process moves to a finishing reduction stage. In the finishing reduction stage the oxygen blowing speed is reduced to perform a top-blow in a ratio of 60 $Nm^3$/min, and to perform a bottom-blow in a ratio of 60 $Nm^3$/min. After 10 min of fining reduction process, the resultant molten iron was tapped. The overall process period was 69.95 min.

Immediately before entering into the finishing reduction process, the temperature of the molten iron bath was measured by means of a sub lance. The measured temperature was 1570° C. The proves that the temperature of the molten iron bath was maintained substantially constant.

Molten iron bath temperature and composition of tapped molten iron are shown in the following table XXI.

TABLE XXI

| Temp °C. | C | Si | Mn | P | S | Cr | Ni |
|---|---|---|---|---|---|---|---|
| 1554 | 6.06 | — | 0.39 | 0.032 | 0.009 | 2.73 | |

On the other hand, the composition of the slag at tapping is shown in the following table XXII.

TABLE XXII

| T.Fe | T.C | $SiO_2$ | MnO | $P_2O_5$ | S | $Al_2O_3$ | CaO | MgO | T.Cr |
|---|---|---|---|---|---|---|---|---|---|
| 0.7 | 2.31 | 14.7 | 0.1 | 0.01 | 0.569 | 23.71 | 37.5 | 16.34 | 0.6 |

The charge charged in the converter is shown in the following table XXIII

TABLE XXIII

| Pig Iron | Scrap | Cr Pellet | Coke | Lime | Dolomide | O2 | Pr | N2 |
|---|---|---|---|---|---|---|---|---|
| 41.3 t | 22.9 t | 23.35 t | 29.02 t | 5.74 t | 2.28 t | 19575 | 245 | 1764 |

In the experiment set out above, the Cr reduction yield was 95.21%, the molten iron production yield was 92.72% and the Ni reduction yield was 100%.

EXAMPLE 6

Other experiments were performed for checking efficiencies of production of chromium containing molten iron when the finishing reduction stage was performed and not performed. In addition, a conventional process with final reduction process and without finishing reduction process were performed in order to obtain comparative data. The result is shown in the following table XIV.

TABLE XIV

| | Example 1 | Example 2 | Comp. 1 | Comp. 2 |
|---|---|---|---|---|
| Pig Iron (t) | 41.3 | 40.7 | 38.7 | 39.7 |
| Scrap (t) | 23.4 | 22.9 | 23.0 | 23.0 |
| Cr Pellet (t) | 26.78 | 21.95 | 25.84 | 24.54 |
| Coke (t) | 29.74 | 27.42 | 26.19 | 26.60 |
| Oxygen ($Nm^3$) | 21120 | 19440 | 21707 | 21087 |
| Lime (t) | 6.25 | 5.39 | 6.46 | 5.99 |
| --Dolomite--. t | 2.34 | 2.31 | 2.15 | 2.14 |
| Tap C (%) | 5.46 | 5.57 | 5.54 | 5.21 |
| Tap Cr (%) | 16.43 | 15.26 | 14.90 | 14.77 |

TABLE XIV-continued

| | Example 1 | Example 2 | Comp. 1 | Comp. 2 |
|---|---|---|---|---|
| Tap Temp. (°C.) | 1557 | 1562 | 1565 | 1576 |
| Cr Yield (%) | 93.5 | 96.0 | 80.4 | 84.2 |
| Iron Production Yield (%) | 92.3 | 93.5 | 88.9 | 90.5 |
| Tapping Amount (t) | 73.2 | 70.6 | 67.4 | 68.8 |
| Blowing Time (min) | 72 | 69 | 74 | 78 |
| Finishing Reduction (min) | — | 10 | — | 10 |
| Scrap Melting Step (min) | 26.9 | 26.9 | — | — |
| Reduction Step (min) | 45.1 | 32.1 | — | — |

In the foregoing table VII, example 1 is the result obtained from the preferred process but without performing a finishing reduction, example 2 is the result obtained from the preferred process with the finishing reduction, comp. 1 is comparative example performed according to the conventional process and without performing finishing reduction, and comp. 2 is a comparative example performed according to the conventional process with finishing reduction.

As will be appreciated herefrom, the present invention enables one to perform production of the chromium containing molten iron with the converter with satisfactorily high yield. Furthermore, according to the present invention, damage to the refractory wall of the converter can be minimized.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

What is claimed is:

1. A process for producing chromium containing molten iron having a low sulphur content, comprising the steps of:

providing a container which has a top and bottom-blowing capability;

forming a molten iron bath containing CaO, $SiO_2$, MgO and $Al_2O_3$ and slag in said container with molten pig iron containing sulphur;

adjusting the slag to provide a ratio of $CaO/SiO_2$ in the range of 2.1 to 3.5 and a ratio of $MgO/Al_2O_3$ in the range of 0.6 to 0.8; and charging chromium containing material and carbon containing material to said molten iron bath in said container while blowing agitation gas into the bath top and bottom to form low sulphur chromium containing molten iron.

2. A process as set forth in claim 1 wherein the molten pig iron contains sulphur and wherein the content of sulphur in the final product of molten iron is controlled to be smaller than or equal to 0.015 wt %.

3. A process as set forth in claim 1, wherein the molten iron produced containing chromium in a range of about 5 wt % to 35 wt %.

4. A process as set forth in claim 1, which further comprises the step of continuously charging flux in a controlled amount to maintain the ratio of $CaO/SiO_2$ in said range of 2.1 to 3.5 and the ratio of $MgO/Al_2O_3$ in said range of 0.6 to 0.8.

5. A process as set forth in claim 4, wherein said flux comprises lime or dolomite.

6. A process as set forth in claim 4, which further comprises the step of continuously charging flux in a controlled amount so as to maintain the ratio of $CaO/SiO_2$ in said range of 2.3 to 3.5 in a manner to control the content of sulphur in the final product of molten iron to a value smaller than or equal to 0.008%.

7. A process as set forth in claim 1, which further comprises the step of charging chromium containing scrap during formation of said molten iron bath.

8. A process as set forth in claim 7, wherein the process for producing chromium containing molten iron, comprises the steps of:

charging chromium containing scrap and molten pig iron containing sulphur to a top and bottom-blown converter for forming a molten iron bath;

performing a scrap melting and heating step comprising top blowing of oxygen while charging carbon containing material and slag forming agent through the top of said converter for melting said chromium containing scrap and heating said molten iron bath; and performing a reduction stage operation subsequent to said scrap melting and heating stage operation, comprising top blowing of oxygen while charging carbon containing material and chromium oxide through the top of said converter for reducing chromium and thus forming chromium containing molten iron.

9. A process as set forth in claim 8, wherein said scrap melting and heating step is performed for heating said molten iron bath at a temperature higher than or equal to 1500° C.

10. A process as set forth in claim 8, wherein said scrap melting and heating step is performed in a manner to establish a relationship between carbon concentration [C] and chromium- concentration [Cr] satisfying the following formula:

$$[C] \geqq 4.03 + 0.84 \times [Cr]$$

11. A process as set forth in claim 9, wherein said scrap melting and heating step is performed in a manner to establish a relationship between carbon concentration [C] and chromium concentration [Cr] satisfying the following formula:

$$[C] \geqq 4.03 + 0.84 \times [Cr]$$

12. A process as set forth in claim 8, wherein said scrap melting and heating step is separated into two series steps, in which a first scrap melting step is performed in advance of a second heating step, for melting said scrap and said second heating step is performed subsequent to said first scrap melting step for increasing the temperature of said molten iron bath to a temperature higher than or equal to 1500° C. and adjusting the carbon concentration [C] versus the chromium concentration [Cr] to satisfy the following formula:

$$[C] \geqq 4.03 + 0.84 \times [Cr]$$

13. A process as set forth in claim 12, which further comprises the step of monitoring the condition of the molten iron bath and detecting the timing for transition between said first scrap melting step and said heating step on the basis of the monitored condition.

14. A process for producing chromium containing molten iron having a low sulphur content, comprising the steps of:

forming a molten iron bath containing CaO and $SiO_2$ in a top and bottom-blown converter with molten pig iron containing sulphur;

adjusting the ratio of $CaO/SiO_2$ in the slag in said molten iron bath to the range of 2.1 to 3.5; and charging chromium containing material and carbon containing material to said molten iron bath in said container while blowing agitation gas into the bath to form low sulphur chromium containing molten iron.

15. A process as set forth in claim 14, wherein the content of sulphur in the final product of molten iron is controlled to be smaller than or equal to 0.015 wt %.

16. A process as set forth in claim 15, wherein the molten iron produced contains chromium in a range of about 5 wt % to 35 wt %.

17. A process as set forth in claim 14, which further comprises the step of continuously charging flux at a controlled amount so as to maintain the ratio of $CaO/SiO_2$ in said range of 2.3 to 3.5 in a manner to control the content of sulphur in the final product of molten iron to a value smaller than or equal to 0.008%.

* * * * *